United States Patent [19]
Harris et al.
[11] 4,264,359
[45] Apr. 28, 1981

[54] JEWELRY ALLOY

[75] Inventors: William R. Harris; Harald G. Jache, both of Owatonna, Minn.

[73] Assignee: Jostens Inc.,, Minneapolis, Minn.

[21] Appl. No.: 65,000

[22] Filed: Aug. 8, 1979

[51] Int. Cl.[3] ..... C22C 30/06
[52] U.S. Cl. ..... 75/134 B; 75/134 C; 148/32
[58] Field of Search ..... 75/134 B, 134 C; 148/32

[56] References Cited

U.S. PATENT DOCUMENTS 2,050,077 8/1936 Wise ..... 75/134 C

*Primary Examiner*—R. Dean
*Attorney, Agent, or Firm*—Schroeder, Siegfried, Ryan, Vidas, Steffey & Arrett

[57] ABSTRACT

An alloy of gold, palladium, silver, copper, zinc and a small quantity of boron is provided to produce an alloy having a pleasing yellow color, high tarnish resistance and a hardness suitable for use as a material for rings and similar jewelry.

7 Claims, No Drawings

JEWELRY ALLOY

BACKGROUND OF INVENTION

The present invention is directed to a new alloy composition which combines essentially all of the advantages of expensive jewelry alloys such as 10 karat gold without the high costs of such material.

With the rising costs of gold and other precious metals, it is highly desirable to have available alloys which make use of as low quantities as these precious metals are possible while retaining their highly desirable appearance, tarnish resistance, and wear resistance. Even with alloys as low in gold content as 10 karat, the current costs of gold alone in such alloys is well in excess of $125 an ounce. Through the forming of a new alloy in accordance with the present invention, this cost is markedly reduced as the new alloys have a gold content of only 6 karat while retaining essentially all of the desirable characteristics of the higher gold content alloys.

DESCRIPTION OF INVENTION

In accordance with the invention, a metal alloy is provided consisting essentially of 25% gold, 11.75%–12.60% palladium, 9.75%–12.10% silver, 8.90%–10.25% zinc, 0.045%–0.65% boron and the balance essentially copper. When percentages are used herein, it will be understood that it is intended to mean percent by weight of total composition.

A preferred alloy will consist of 25.0% gold, 12.25% palladium, 10.05% silver, 9.64% zinc, and 0.55% boron with the balance essentially copper. The alloys in accordance with the invention have a unique yellow color which is attractive although slightly less yellow than that of 10 karat gold. Tarnish resistance to normal tarnishing agents such as hydrogen sulfide, gas, sulfur dioxide and carbon dioxide at 100% humidity is essentially equivalent to 10 karat gold. The hardness of the resulting alloy when treated in accordance with the procedure below will be from 80–85 Rockwell–B.

The alloys of the invention also have been found to be particularly suitable for investment casting of jewelry as they hold very good depth tolerance and uniformity of composition provided that the cast alloy is quenched within a time period from within 4–7½ minutes. A greater or lesser time of quenching of the newly cast alloy adversely affects the ductility. If quenching is done too slowly, the results may be precipitation of palladium at the surface of the casting.

In the forming of the bulk alloy material, it is desirable to use a copper-boron alloy as the source for boron to be incorporated into the final alloy. It has been found that a useful alloy for this purpose of a copper boron alloy containing approximately 2% boron. The function of the boron in the alloy of the invention is principally for the purpose of providing good castability by virtue of the deoxidizer effect of the boron.

We claim:

1. An alloy suitable for use in fabricating jewelry consisting essentially of about 25% by weight gold, about 11.75% to 12.60% by weight palladium, about 9.75% to 12.10% by weight silver, about 8.90 to 10.25% zinc, and about 0.045% to 0.065% by weight boron, balance copper.

2. An alloy in accordance with claim 1 wherein gold is 25% by weight, palladium is about 12.25% by weight, silver is about 10.05% by weight, zinc is about 9.64% by weight, boron equals 0.055% by weight and the balance is copper.

3. An article of jewelry formed of the alloy of claim 1.

4. An article of jewelry formed of the alloy of claim 2.

5. An article of jewelry in accordance with claim 3 wherein the cast alloy has been quenched within a time period of from 4 to 7½ minutes after casting.

6. An article of jewelry in accordance with claim 5 wherein the color of the casting is substantially that of gold.

7. An article of jewelry in accordance with claim 2 wherein the color is substantially that of gold and where the jewelry casting has been quenched within a time period of from 4 to 7½ minutes after casting.

* * * * *